US005529289A

United States Patent [19]

Lancer, Sr.

[11] Patent Number: 5,529,289

[45] Date of Patent: Jun. 25, 1996

[54] PLASTIC MULTI-FUNCTIONAL PRIVACY FENCE

[76] Inventor: Robert W. Lancer, Sr., 7914 Fairdale, Houston, Tex. 77063

[21] Appl. No.: 435,984

[22] Filed: May 5, 1995

[51] Int. Cl.[6] ..... E04H 17/16

[52] U.S. Cl. ..... 256/66; 256/19; 256/24

[58] Field of Search ..... 256/66, 19, 24, 256/25; 52/478, 536, 542

[56] References Cited

U.S. PATENT DOCUMENTS

| | | | |
|---|---|---|---|
| 2,740,613 | 4/1956 | Berliner | 256/19 X |
| 2,877,600 | 3/1959 | Slate | 256/24 X |
| 3,452,500 | 7/1969 | Heirich | 52/478 |
| 3,711,066 | 1/1973 | Niemiec . | |
| 3,955,801 | 5/1976 | Soriero, Jr. . | |
| 4,124,198 | 11/1978 | Wong . | |
| 4,306,631 | 12/1981 | Reusser | 256/24 X |
| 4,357,000 | 11/1982 | Tisbo et al. . | |
| 4,477,058 | 10/1984 | Lowery . | |
| 4,722,514 | 2/1988 | Pettit . | |
| 4,918,898 | 4/1990 | McLeod, Jr. | 52/478 X |
| 4,964,618 | 10/1990 | Kennedy | 256/24 |
| 5,149,061 | 9/1992 | Borgnini | 256/24 |
| 5,255,897 | 10/1993 | Pepper . | |
| 5,441,240 | 8/1995 | Arnold | 256/66 X |

FOREIGN PATENT DOCUMENTS

| | | | |
|---|---|---|---|
| 381289 | 8/1990 | European Pat. Off. | 256/24 |
| 1534267 | 11/1978 | United Kingdom | 256/24 |
| 2054692 | 2/1981 | United Kingdom | 256/24 |

*Primary Examiner*—Anthony Knight
*Attorney, Agent, or Firm*—John B. Moetteli

[57] ABSTRACT

A privacy fence is provided which protects against intrusion of persons and animals as well as provides both a sight and sound barrier for an outdoor space such as a yard. The invention is comprised of vertical slats which interlock along each adjacent edge to create an effective barrier against the intrusion of unwanted noise or animals and at the same time eliminate any flaws or inconsistencies (such as knots) normally found in wooden fences which may be considered breaches of the integrity of the fence in its function as a privacy fence.

3 Claims, 5 Drawing Sheets

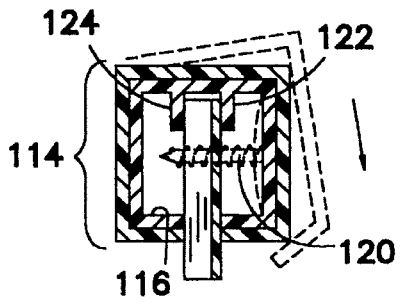
FIG. 6
FIG. 5
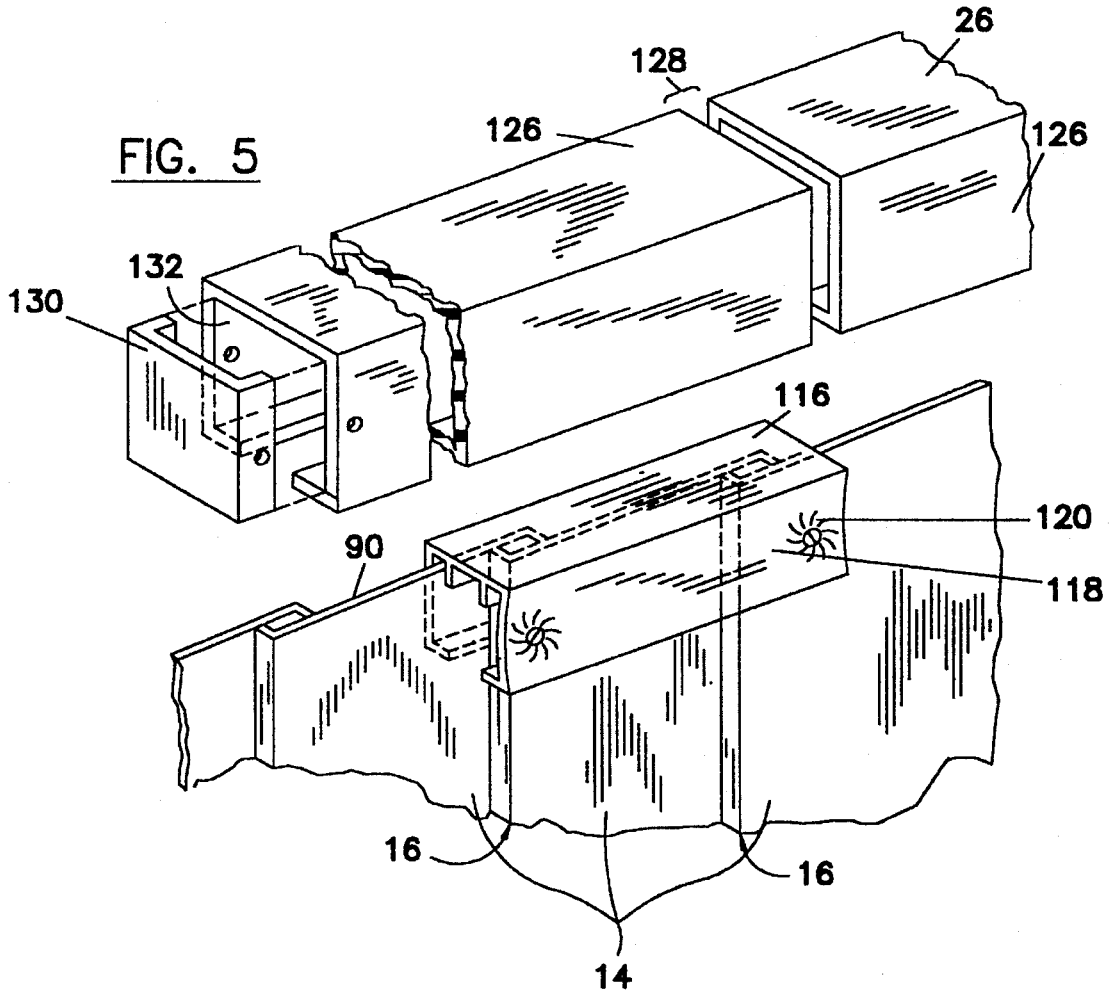
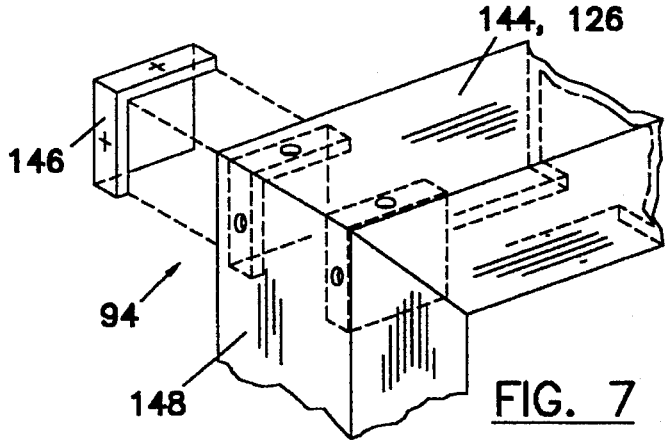
FIG. 7

PLASTIC MULTI-FUNCTIONAL PRIVACY FENCE

TECHNICAL FIELD

This invention relates generally to plastic fence structures, and more particularly to plastic privacy fence structures having vertical interlocking slats.

BACKGROUND

It is commonly known that conventional wooden fences have several inherent negative characteristics. These include relatively high cost, short life expectancy due to susceptibility to rot, tendency to rapidly discolor, and natural imperfections such as knots which almost completely preclude a wooden fence from functioning as an effective privacy fence. In addition, many persons erroneously believe that owning a natural wooden fence is the correct ecological choice. However, comparable alternatives in plastic have substantially greater durability and life expectancy. Such materials (e.g. phenolics, polyimides, polypropylene, polystyrene, rubber and vinyl polymers including PVC (polyvinyl chloride)) are available which effectively resist cracks, chipping, peeling, discoloration, solar-radiative embrittlement, chemical attack and fires. In addition, because of their durability and recyclability, such alternatives do not directly contribute to the destruction of our national forests. This should be compared with the fact that an old and rotten wooden fence cannot be recycled. Further, many new wooden fences will require replacement within twelve to twenty years, thereby necessitating the ongoing destruction of our forest lands.

Although wooden fences are more natural and organic in appearance than fences constructed of artificial materials, current technology is capable of providing an convincingly wooden appearance to plastic material by embossing, forming or molding a well defined wood grain texture to such materials. Such materials may be molded with pigmented material in any of an almost unlimited range of colors which can be selected to simulate wood convincingly. These plastic materials, because they are produced by tightly controlled and repeatable processes, are made with few visible imperfections and almost no voids or pores which might otherwise compromise the effectiveness of the fence as a privacy screen. These processes (extrusions for example) produce intricate shape of accurate size which enable excellent repeatability such that mating parts fit together with relative precision.

Lowry U.S. Pat. No. 4,477,058 describes a fence constructed of plastic components whose functions includes that of a privacy fence. However, because each plastic board abuts and does not overlap or interlock with an adjacent board, gaps still exist between boards. In addition, the gaps may easily become enlarged if any bowing or warping occurs in adjacent boards. Therefore, it is still relatively easy for a curious person to peer between the slats to obtain a view of events taking place on the other side. Although an improvement over wooden fences in that it is made of durable material and does not contain the knots, it is not completely effective as a privacy fence.

Pepper U.S. Pat. No. 5,255,897 describes a privacy fence made of plastic. However, adjacent vertical slats do not interlock. This creates gaps or "elongated spaces" between adjacent slats into which a second "elongated member" may be placed in order to convert this fence into a privacy fence. This requires that a second component be installed and therefore is inconvenient as compared to solutions which do not require the installation of this additional component.

Wong U.S. Pat. No. 4,124,198 describes a plastic fence having horizontally abutting sheets or panels which utilize "four keys extending from both sides of the sheet." Such an arrangement permits gaps to exist between the ends of each sheet and the mating "post section." Therefore this design is not completely effective as a privacy fence. By its design it's appearance is not that of a conventional wooden fence—this may further detract from its attractiveness as a substitute for wooden fencing.

A need therefore exists for an improved privacy fence which can reduce manufacturing costs, increase durability and increase isolation of an outdoor space against the intrusion of objectionable sounds, noises and curious persons.

SUMMARY

The present invention is directed to an improved privacy fence for creating a physical barrier that satisfies the needs identified above.

In its preferred embodiment, vertical plastic slats are provided having opposite edge configurations of compatible gender which allow mating of adjacent slats when constructing a privacy fence. Such opposite edge configurations further comprise an optional stiffening feature of a cross-section resembling a fan-fold which further functions to conceal fastener heads or other attachment means so that a smooth, visually pleasing appearance may be attained.

The preferred embodiment is comprised of a substantially Z-shaped cross section. The cross-section between the mating opposite edge configurations may be planar (the diagonal of the "Z" shape) or may comprise a step defining two planes and a connecting plane substantially perpendicular to the two aforementioned planes. Alternatively, a wave form or other cross section may be used advantageously to further stiffen the slat. The interlocking and overlapping seam created when mating opposite edge configurations are engaged functions as both a sight and sound barrier for a space such as a yard and protects against intrusion of persons and animals as well. Tongue-and-groove interfaces, dovetail-type interfaces and interlocking channel interfaces, of the type commonly known in the art may substitute for the interlocking and overlapping seam interface any such interface having opposite interlockable edges of compatible gender will suffice.

The slats may optionally be provided with corrugations to simulate weathered wood and to still further stiffen the slats. Such a simulated wood grain appearance may be rolled or embossed onto the material after extrusion. Strength and stiffness of the slats may be further enhanced where corrugated striations are extruded into the slat during the extrusion process, this process being generally known as the most common and economical manufacturing method for large-scale production of plastic products of uniform cross section.

Trim along the top and sides of the fence may be provided to give the privacy fence a finished look, to rigidize the assembly and to protect the top edge of the fence against damage from abuse. It is contemplated that a variety of ornamental designs can be molded or otherwise fabricated into the trim to enhance its visual appeal.

Further, the sound attenuation ability of the privacy fence invention herein disclosed may be enhanced by sealing each seam created between adjacent slats with a sealant such as glue or caulk. Such sound attenuation may yet be significantly enhanced by attaching two barriers of vertical slats onto opposite sides of a single frame structure.

The function of the invention as a sight barrier is enhanced by the ease with which construction permits free vertical positioning prior to fastening thus enabling close abutment of the lower slat end with the sloping terrain. This also enhances the ability of the fence to act as a barrier to unwanted intrusion by pets. Optionally, the slat ends may be buried into the ground, thereby further enhancing the ability of the invention to act as a barrier to sound or burrowing animals. In this case, construction of plastic will enhance the durability of the fence as plastic is relatively unaffected by moisture and does not rot as does wood or rust or corrode as does metal. In addition, plastic resists nicks and dents, does not peel, and when impacted, tends to return to its original shape.

Installation of the invention is simple and inexpensive, requiring only unskilled laborers. No field cutting or special tooling is required. When installing plastic slats, no drilling is required when attaching to wood framing. Fastening locations are easy to determine since framing rail is readily visible to the fence slat being installed.

Maintenance of the plastic fence is simple as well. In order to clean the plastic fence made according to the teachings of this invention, one need only occasionally wash the fence using a hose and a light detergent. In addition, storm damage or damage by vandalism can be easily repaired without disassembling to the end of the run—the damaged slats may simply be removed and the replacement slats attached in the normal manner.

DESCRIPTION OF THE DRAWINGS

Other objects and advantages of this invention will become readily apparent as the same is better understood by reference to the following detailed description when considered in connection with the accompanying drawings wherein:

FIG. 5 shows a isometric view of an optional top trim assembly for use where the fence framing rail is below the top of the slats;

FIG. 6 shows a sectional side view of the optional top trim assembly in FIG. 5;

FIG. 7 shows a corner trim detail of an optional top trim assembly;

DETAILED DESCRIPTION

Figure 1:
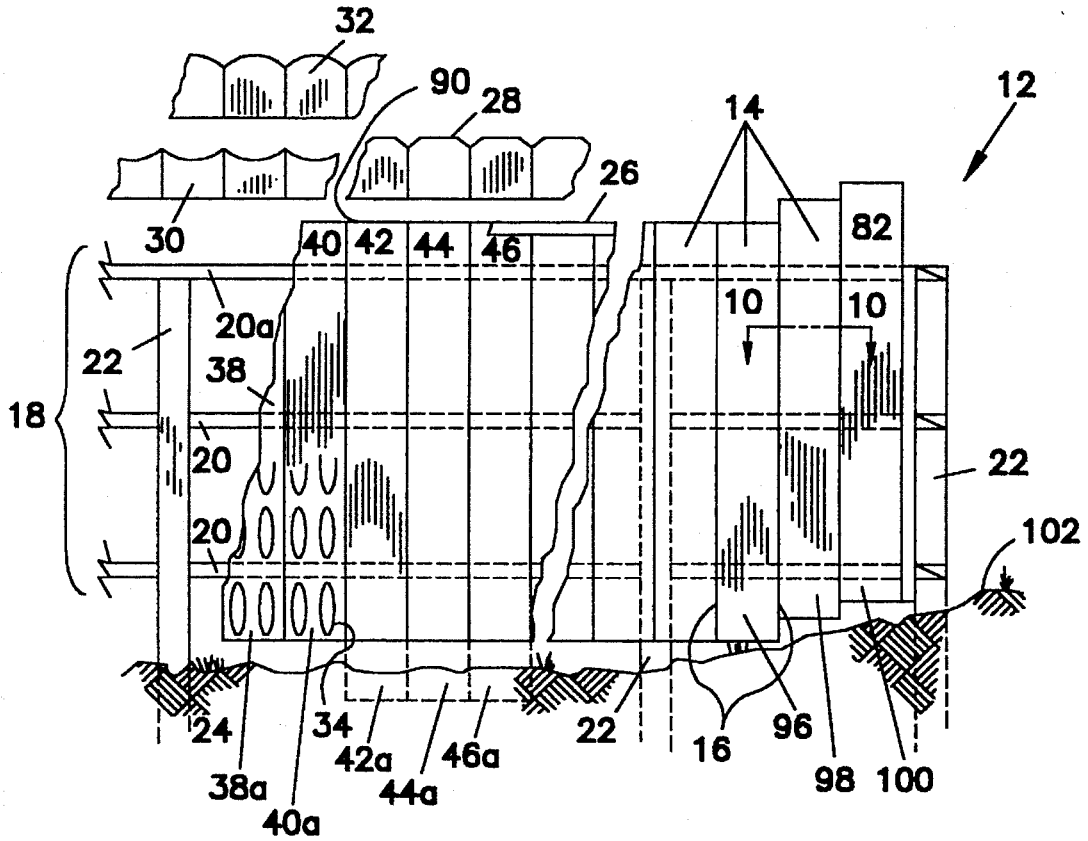
FIG. 1 shows a front view of the of a privacy fence in accordance with the teachings of the present invention.

Referring now to the drawings wherein is shown a preferred embodiment and wherein like reference numerals designate like elements throughout the several views, there is shown in FIG. 1 a front view of a privacy fence in accordance with the teachings of the present invention.

In its simplest form, such fence 12 is comprised of a horizontal array of vertical slats 14 interlocked at mating seams 16 and attached to a structure constituting a frame 18 which further provides rigidity to the fence 12. Such frame 18 is comprised of horizontal rails or girts 20 attached via fasteners such as nails to vertical posts 22 which are themselves anchored to the ground 24 in a conventional fashion. Decorative trim features 26, 28, 30 and 32 are depicted, such as the addition of top trim molding 26, and the alternative dog-ear trim 28 or trim having a concave 30 or convex 32 appearance as shown in the alternative cut-aways in FIG. 1. An embodiment showing the perforations or holes 34 placed in the bottom portion 38*a* and 40*a* of the slats 38 and 40. Slat 42, 44, and 46 depict an alternative embodiment in which the slat ends 42*a*, 44*a*, and 46*a*, shown in phantom, may be buried into the ground 24.

Figure 2A:
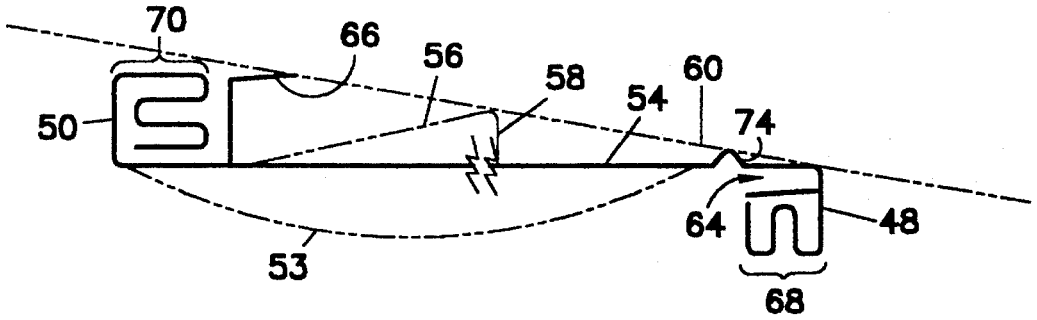
FIG. 2A shows a sectional top view of an individual slat of which the privacy fence of FIG. 1 is comprised.
Figure 2B:
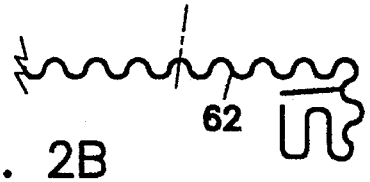
FIG. 2B shows a sectional top view of a portion of an individual corrugated slat.

FIG. 2A shows a sectional top view of a single representative slat. Such slat is comprised of first and second interlockable edges 48 and 50 of compatible gender connected by a panel 52 which constitutes the visible surface of the slat. The preferred embodiment is comprised of a substantially Z-shaped cross section. The panel 52 may be planar (the diagonal of the "Z" shape) or may comprise a step defined by two planes 54 and 56 connected by a third plane 58 substantially perpendicular to the two aforementioned planes, thereby creating the appearance of two slats (shown in phantom lines in FIG. 2A). Alternatively, a wave form 53 (shown in phantom in FIG. 2A) or other cross section may be used advantageously to further stiffen the slat. Essentially, the panel 52 can be designed of a cross section which is limited only by the imagination of the designer, comprising essentially any profile which does not intrude beyond the surface of the girt or rail to which the slat is attached as depicted by phantom line 60. For example, fine striations, corrugations, course sinusoids, step functions or any variation of these may be used. Alternatively, a simulated wood grain appearance may be rolled or embossed onto the plastic material after extrusion. Strength and stiffness of the slats may thereby be enhanced particularly where corrugated striations 62 similar to those shown in FIG. 2B are formed into the slat during the extrusion process, this process being generally known as the most common and economical manufacturing method for large-scale production of plastic products of uniform cross section.

Figure 3:
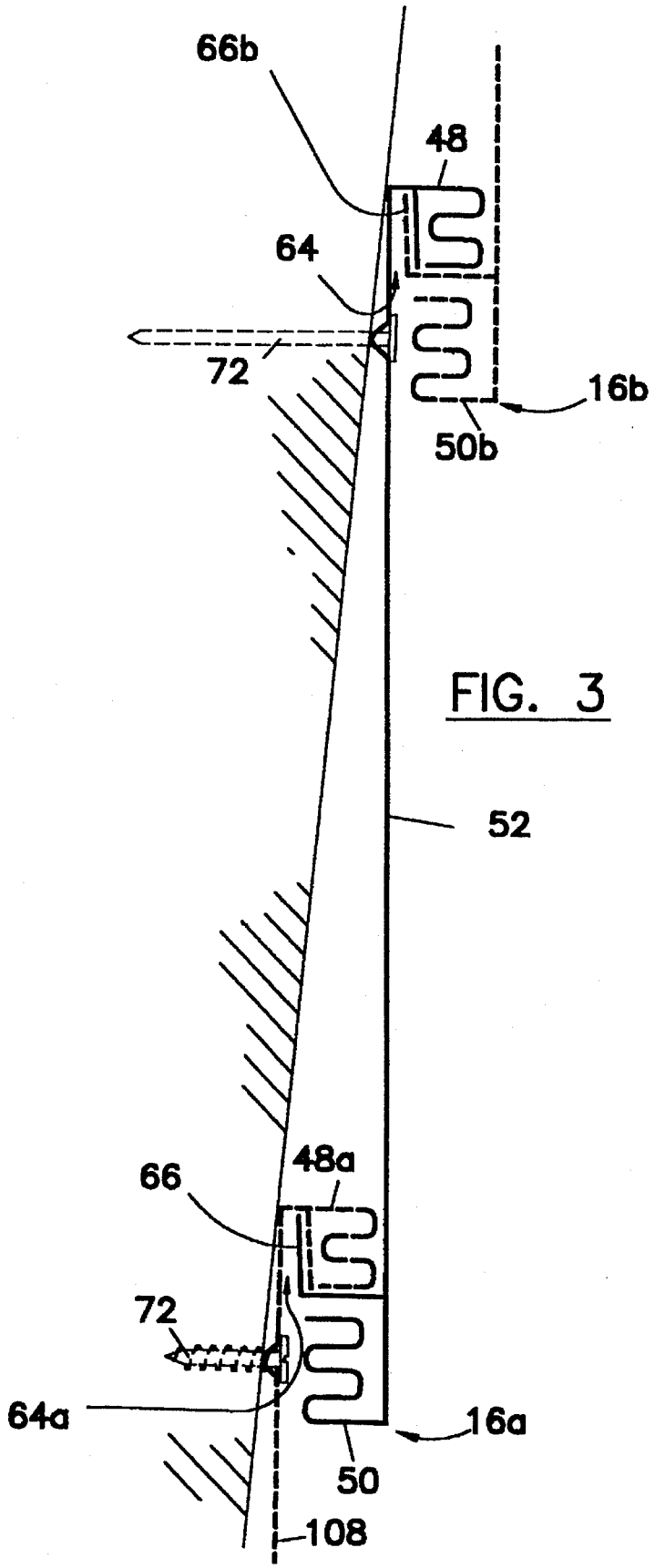
FIG. 3 shows a sectional top view of privacy fence taken along line 10—10 in FIG. 1.

The first interlockable edge 48 is shown of a female gender having a interlock groove 64 for receiving the male interlock leg 66, although it is only necessary that the first and second interlockable edges 48 and 50 be provided of compatible gender (therefore, this first interlockable edge 48 may be of male or dual gender, provided the second interlockable edge 50 is of female or dual gender). Such first and second interlockable edges 48 and 50 further comprise optional stiffening features 68 and 70 of a cross-section resembling a fan-fold. Such fan-fold features 68 and 70 are hidden from view by virtue of the design of the slat. The fan-fold feature 70 of the second interlockable edge 50 further functions as an overlapping portion which conceals fasteners 72 or other attachment means as shown in FIG. 3 so that a smooth, visually pleasing appearance may be attained. Finally, a nailing or fastening groove 74 is shown to aid in installation.

The first and second interlockable edges 48 and 50 of compatible gender allow mating of the interlockable edges of adjacent slats when such slats are placed in an array such as shown in FIG. 3. The interlocking and overlapping seams 16*a* and 16*b* created when mating interlockable edges 48 and 50*b* or 48*a* and 50 shown in the figure are engaged functions as both a sight and sound barrier for a space such as a yard and protects against intrusion of persons and animals as well.

Figure 8A:
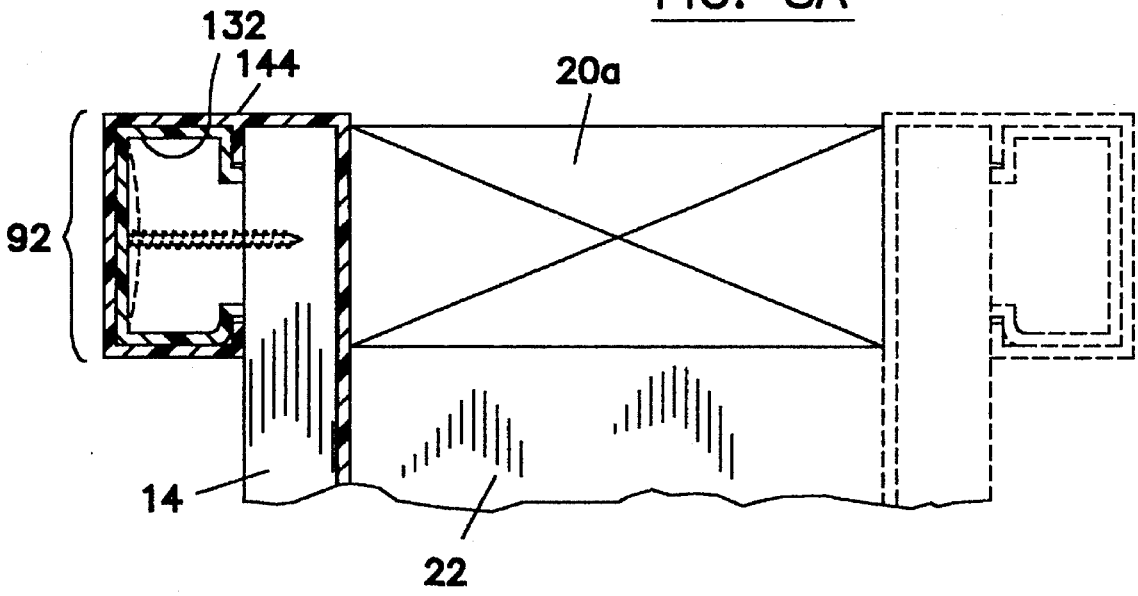
FIG. 8A shows a sectional side view of an optional trim assembly of a two-sided privacy fence for use where the fence framing rail is flush with the top of the slats.

Further, the sound attenuation ability of the privacy fence invention herein disclosed may be enhanced by sealing each seam 16 created between adjacent slats with a glue or caulk in the mating areas, two representative examples of which are depicted in FIG. 3 immediate the interlock leg 66 and 66*b* and interlock groove 64*a* and 64, respectively. Such sound attenuation may be enhanced still further by attaching two barriers of vertical slats 14 to both sides of a single frame structure 18 as depicted in FIG. 8A.

Figure 4A:
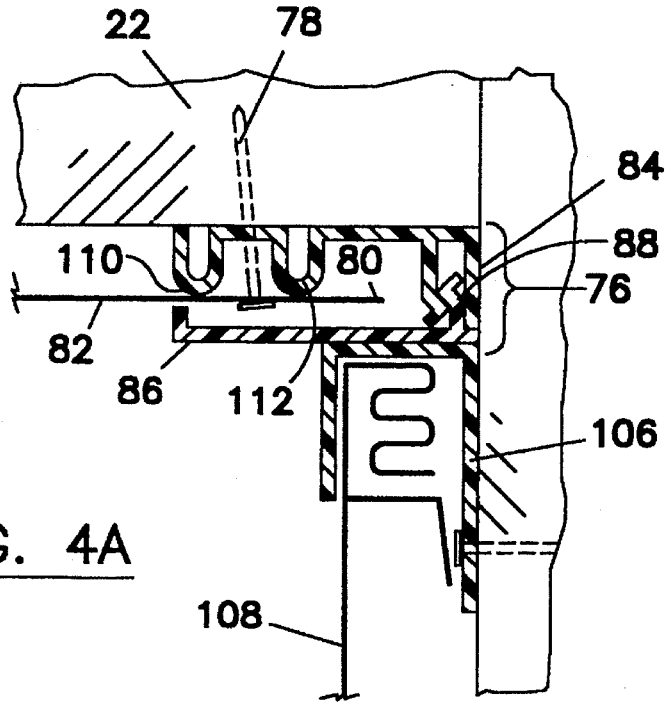
FIG. 4A shows a sectional top view of an inside corner assembly of the privacy fence.
Figure 4B:
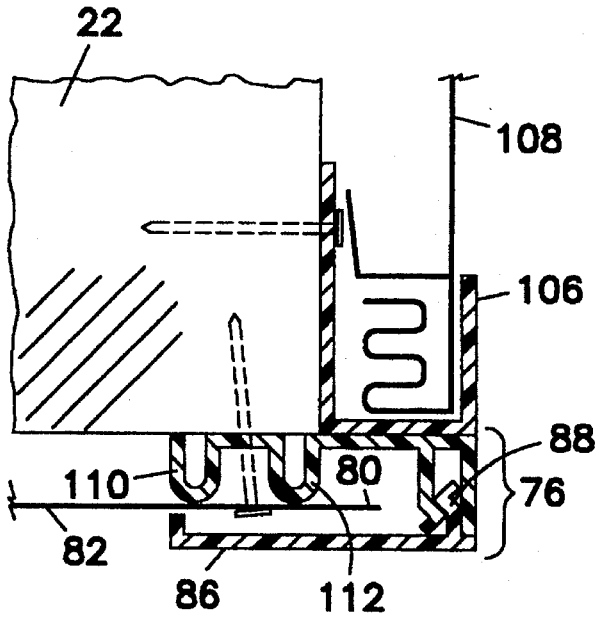
FIG. 4B shows a sectional top view of an outside corner assembly of the privacy fence.

Because of the necessity of trimming fences of a span which does not exactly correspond with a total length equal to a multiple of the width of the individual slat of the horizontal array 14, a special terminal trim assembly 76 is provided which attaches via fasteners 78 to the end or corner post 22 in such a position that the special terminal trim assembly 76 captures the trimmed-to-fit edge 80 of the last slat 82 in a horizontal array 14 and holds it securely in place without the necessity of using fasteners 72 or of mating with a second interlockable edge 50 (more detail is provided on installation method below). In its preferred embodiment, this terminal trim assembly 76 is comprised of an extruded channel 84 and a cover 86 which when mated together via a molded snap joint 88 as shown in FIGS. 4A and 4B, or alternatively via conventional fasteners such as a pan head wood screw or nail, the assembly captures the trimmed-to-fit edge 80 of the last vertical slat 82, thereby preventing movement and securely holding the slat 82 in place.

In accordance with one aspect of the present invention, the fence 12 may be trimmed with molding (e.g. 26, FIG. 1) at its edges in a variety of fashions in order to provide a more finished look and to prevent damage from abuse. Examples of means of trimming the edges are as shown in FIG. 5 and 7, an isometric view and sectional view of an optional top trim assembly 26 for use where the top framing rail 20*a* is below the top 90 of the slats, FIG. 8A which shows a sectional side view of an optional trim assembly 92 used on a two-sided privacy fence where the framing rail 20*a* is flush with the top 90 of the slats; and FIG. 7 which shows a corner trim detail of an optional top trim assembly 94. It is contemplated that a variety of ornamental designs can be molded or otherwise fabricated into the trim to enhance its visual appeal. For example, wood top trim and corner trim could easily be substituted for plastic.

In accordance with another aspect of the present invention, the function of the invention as a sight barrier is enhanced by the ease with which construction permits independent vertical positioning of each slat prior to fastening the slat thus enabling close abutment of the lower slat end with the sloping terrain without necessitating trimming of each slat end. Such abutment is depicted by slat ends 96, 98 and 100 as they follow the sloping terrain 102 as shown in FIG. 1. Such ability to independently vertically position the slat is a natural consequence of the nature of an extrusion in that it has a consistent cross section along its length. Further, overlapping interlocking seams 16 preclude the ability of a curious person to see through the seam—there is simply no gap through which to see. The overlapping seam 16 and ability of the lower edge of a slat to follow a sloping terrain enhances the ability of the fence 12 to act as a barrier to unwanted intrusion by pets. Optionally, the slat ends may be buried into the ground, thereby further enhancing the ability of the invention to act as a barrier to sound or burrowing animals. Such is depicted in FIG. 1 by the phantom lines outlining the ends 42*a*, 44*a*, and 46*a* of three representative slats 42, 44, and 46. In this case, construction of plastic will enhance the durability of the fence 12 as such material is relatively unaffected by moisture and does not rot as does wood.

In accordance with still another aspect of the present invention, perforations or holes 34 may be punched into the planar exposed faces 52 of the slats as shown in FIG. 1. Such perforations 34 together with an unsealed interlocking seam 16 provide for water flow sufficient for ordinary storm water drainage and for air flow as well. Such perforations 34 may be limited to locations sufficiently near the ground so as to maximize privacy. Alternatively, where privacy is not a concern, perforations 34 may extend along the full length of the slats in order to promote air circulation.

Installation of the invention is simple and inexpensive, requiring only unskilled laborers. No field cutting of fence slats is required, except for the need in some cases to cut the last piece of a run as designated by numeral 82 in FIG. 1 to decoratively trim each slat, or to maintain a level horizontal edge when enclosing an area which is not level. No special tooling is required. Plastic slats are easily cut with an ordinary fine tooth saw or shears. Alternatively, plastic slats may be scored with a utility knife and snapped apart. Irrespective of any trimming requirement, the slats 14 can be fastened to various frames 18 of wood, metal, plastic or composite materials, provided the frame 18 has horizontal rails of girts 20 to which these slats 14 may be affixed. The installation of an array of slats 14 onto a frame structure 18 comprised of horizontal 2×4 rails or girds 20 and 4×4 vertical posts 22 proceeds as follows: first, a J-channel 106, as shown in FIGS. 4A and 4B is fastened to a post 22 in a vertical orientation, perpendicular to the direction in which the array of slats 14 is to be installed. Second, the second interlockable edge 50 of a single slat 108 is placed into the J-channel opening. Third, the first interlockable edge 48 is fastened to a girt or rail 20 preferably along the nailing groove 74 which provides for precise vertical alignment of the fasteners 72. In addition, it should be noted that no drilling is required when attaching to wood framing as nails or self-tapping fasteners may be used instead. Further, fastening locations are easy to determine since framing rail 20 is readily visible to the fence slat being installed. Fourth, the next slat's second interlockable edge is interlocked with the prior slat along the prior slat's first interlockable edge, thereby concealing the fasteners along the nailing groove. This step is most clearly understood by reference to FIG. 3, in which the second interlockable edge 50 of the next slat 52 is interlocked with the prior slat 108 along the first interlockable edge 48*a* of the prior slat 108, thereby concealing the fasteners 72. Fifth, return to the third step above and repeat the third, fourth and fifth steps until the end of the run or array is reached. Reference is best made now to FIGS. 4A and 4B. If the nailing groove adjacent the first interlockable edge (not shown) of the last slat 82 is not positioned such that a fastener may be laid into the post 22 through the nailing groove, then the following procedure may be followed:

(1) the first interlockable edge of this last slat is snapped or cut off.

(2) the first interlockable edge is discarded.

(3) the terminal trim channel 84 is fastened in place such that the newly created edge 80 of the last slat 82 extends onto a land defined by the crests of curved projections 110 and 112 of the terminal trim channel 84.

(4) the cover 86 is snapped in or otherwise attached to the terminal trim channel 84, thereby securely holding the last slat 82 in place and completing a single array of slats 14.

An optional top trim assembly 114 for use where the fence framing rail 20*a* is below the top of the slats 90 is shown in isometric view in FIG. 5. Anchor clips 116 are first placed over the top edge 90 of the horizontal array of slats 14 at spaced-apart intervals. Fasteners 120 are installed in spaced-apart intervals lengthwise along either exposed side surface 118 of the anchor clips 116 such that they fasten into a slat of the horizontal array 14. Downwardly depending flanges 122 and 124 capture the top edge 90 of the horizontal array 14 so that the fastener 120 may be installed under sufficient pressure to cause the head of the fastener 120 to deform or dimple the anchor clip in the immediate vicinity around the head of the fastener so as to recess the head below the plane of the exposed side surface through which the fastener 120 was installed. A finishing top-trim channel 126 is then elastically deformed as shown in FIG. 6 such that the finishing top-trim channel 126 wraps around an adjacent anchor clip 116 and holds itself firmly in place. Of course, additional fasteners can be used to further secure the top trim channel 126. In addition, expansion gaps 128 may be provided at space-apart intervals along the length of the top edge 90 of the horizontal array 14 of slats so as to compensate for thermal expansion and contraction, thus enhancing the durability of the fence 12. To further provide a finished look to the assembly 114, end caps 130 may be fastened to the otherwise open ends 132 of the top-trim channels 126 as shown.

A corner trim detail of an optional top trim assembly 94 shown in FIG. 7 comprises an internal splice plate 146 and trim channel 148 which can be fastened together using preferably self-tapping panhead stainless steel screws. Such a feature allows the top trim channels 144 or 126 of different levels to be connected in an aesthetically pleasing manner.

Figure 8B:
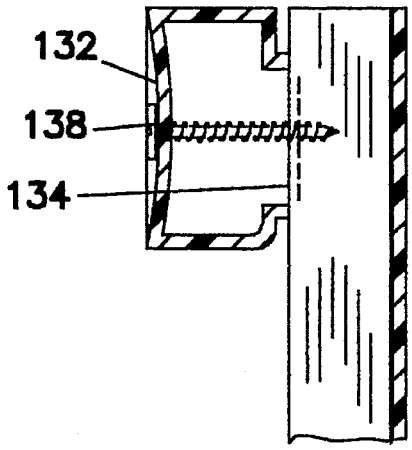
FIG. 8B shows a sectional side view of the side-mounted anchor clip prior to installation of the side-mounted top trim channels.

FIGS. 8A and 8B show a sectional side view of an optional trim assembly 92 of a two-sided privacy fence for use where the fence framing rail 20*a* appears to be flush with the top of the slats 14. In such cases, the top trim assembly 114 as described in FIGS. 5 and 6 cannot be used. Therefore, a side-mounted anchor clip 132 is provided which is fastened directly to the side surface 134 of the horizontal array 14. As with the anchor clips 116 depicted in FIGS. 5 and 6, Fasteners 138 are installed in spaced-apart intervals lengthwise along either exposed side surface 134 of the side-mounted anchor clips 132 such that they fasten into a slat of the horizontal array 14. The fastener 138 may be installed under sufficient pressure to cause the head of the fastener 138 to deform or dimple the side-mounted anchor clip in the immediate vicinity around the head of the fastener so as to recess the head below the plane of the exposed side surface 134 through which the fastener 120 was installed. Once these side-mounted anchor clips 132 are installed in spaced-apart intervals along the edge 90 of each side of the fence to be covered with a horizontal array 14 of slats, then side-mounted top trim channels 144 may be installed around these side-mounted anchor clips 132 in much the same manner as the top trim channels 126 depicted in FIG. 6. Suitable end caps similar to end caps 130 may then be installed in the otherwise open ends of these side-mounted top trim channels 144 to give the assembly 92 a more finished look.

Finally, maintenance of the fence 12 is simple as well. In order to clean the fence 12 made according to the teachings of this invention, one need only occasionally wash the fence 12 using a hose and a light detergent. Storm damage or damage by vandalism can be easily repaired without disassembling to the end of the run of the horizontal array 14. First the fasteners are extracted so that the damaged slats may be removed (exposing the fasteners 72 on the damaged slat may entail snapping off the second interlockable edge 50 that incorporates the fan-fold feature 70). Then, if necessary, the male interlock leg 66 of the last replacement slat is broken or cut off so that the slat may be placed flat against the adjacent slat and fastened into place.

It should be understood that the foregoing disclosure relates to only a preferred embodiment of the invention and that it is intended to cover all changes and modifications of the example of the invention herein chosen for the purposes of the disclosure which do not constitute departures from the spirit and scope of the invention as set forth in the claims.

I claim:

1. A composite privacy fence comprising:

a frame structure comprising a plurality of vertical posts adapted to be anchored to the ground and at least two spaced-apart horizontal rails fastened therebetween;

a horizontal array of adjacent vertical interlocking plastic slats fastened to said frame structure, each of said slats being comprised of two opposite interlockable edges of compatible gender connected by a thin panel, said panel having an external surface which when combined with all other slats of said horizontal array, comprises the majority of the visible surface of said horizontal array; and a trim structure embellishing the top horizontal edge of said horizontal array, comprising:

a plurality of anchor clips fastened to said top horizontal edge at spaced-apart intervals; and at least one finishing channel which mounts over at least one of said anchor clips.

2. A composite privacy fence comprising:

a frame structure comprising a plurality of vertical posts adapted to be anchored to the ground and at least two spaced-apart horizontal rails fastened therebetween; and a horizontal array of adjacent vertical interlocking plastic slats fastened to said frame structure, each of said slats being comprised of two opposite interlockable edges of compatible gender connected by a thin panel, said panel having an external surface which when combined with said slats of said horizontal array, comprises the majority of the visible surface of said horizontal array, the first and second interlockable edges of compatible gender allowing mating of the interlockable edges of adjacent slats when such slats are placed in an horizontal array, said first interlockable edge of each slat having an interlock groove for receiving the male interlock leg of the immediately adjacent slat, and said second interlockable edge having a male interlock leg for being received in the interlock groove of the immediately adjacent slat, said first and second interlockable edges further comprising an optional stiffening feature, said stiffening feature being hidden from view by virtue of the design of the slat, said stiffening feature of the second interlockable edge extending beyond the fasteners of the adjacent slat thereby concealing said fasteners so that a smooth, visually pleasing appearance may be attained.

3. The composite privacy fence of claim 2 wherein said stiffening feature has a cross-section resembling a fan-fold.

* * * * *